US006371479B1

(12) United States Patent
Osaka et al.

(10) Patent No.: US 6,371,479 B1
(45) Date of Patent: Apr. 16, 2002

(54) SWITCHBACK DEVICE FOR USE IN IMAGE FORMING APPARATUS

(75) Inventors: Toshiyuki Osaka, Osaka; Naoki Motobayashi, Kawachinagano; Hiromichi Oguma, Kobe; Hideaki Kimata, Osaka; Yasunori Ueno, Sanda; Hiroshi Kusumoto, Wakayama, all of (JP)

(73) Assignee: Kyocera Mita Corporation, Osaka-fu (JP)

( * ) Notice: Subject to any disclaimer, the term of this patent is extended or adjusted under 35 U.S.C. 154(b) by 0 days.

(21) Appl. No.: 09/512,225

(22) Filed: Feb. 24, 2000

(30) Foreign Application Priority Data

Feb. 25, 1999 (JP) ..... 11-047740
Feb. 25, 1999 (JP) ..... 11-047741

(51) Int. Cl.[7] ..... B65H 29/00

(52) U.S. Cl. ..... 271/186; 271/188; 271/209; 271/902

(58) Field of Search ..... 399/401, 402; 271/3.03, 161, 225, 184, 185, 186, 188, 209, 902

(56) References Cited

U.S. PATENT DOCUMENTS 3,900,192 A * 8/1975 Gibson ..... 271/3.03
6,244,591 B1 * 6/2001 Paulat ..... 271/225

FOREIGN PATENT DOCUMENTS

JP 2-75563 * 3/1990 ..... 271/186
JP 2-225256 * 9/1990 ..... 271/186
JP 4-246055 * 9/1992 ..... 271/186
JP 5-246574 * 9/1993 ..... 271/186

* cited by examiner

*Primary Examiner*—H. Grant Skaggs
(74) *Attorney, Agent, or Firm*—Jordan and Hamburg LLP

(57) ABSTRACT

A switchback device has an inverting tray for temporarily holding a sheet guided inside the switchback device thereon; a guide unit for guiding the sheet in pressing contact with the inverting tray when the sheet exits the switchback device in an exiting direction on the inverting tray, the exiting direction opposite to an entering direction of the sheet on the inverting tray; a guide switching unit for selectively changing the guide unit to a sheet guide allow state to allow the sheet to enter in the entering direction on the inverting tray and a sheet pressing state to make the sheet in pressing contact with the inverting; and a sheet transporting unit for transporting the sheet out of the switchback device in the exiting direction on the inverting tray.

18 Claims, 9 Drawing Sheets

SWITCHBACK DEVICE FOR USE IN IMAGE FORMING APPARATUS

This application is based on patent application Nos. 11-47740 and 11-47741 filed in Japan, the contents of which are hereby incorporated by references.

BACKGROUND OF THE INVENTION

This invention relates to a switchback device for use in image forming apparatus such as copiers, laser printers, and facsimile machines, and particularly to a switchback device for use in image forming apparatus in the technical field of electrophotography.

FIG. 9 is a diagram of a switchback device of prior art for use in an image forming apparatus. Hereinafter, a conventional switchback device is described referring to FIG. 9. The conventional switchback device 7 comprises: a tray 73; a sheet transporting unit 74 including a switchback roller 741, a switchback roller driver (not shown), a movable arm 742, an arm shaft 743, a solenoid 744, an arm bias member 745, and a spring 746; and a sheet slapping unit 75 including a guide member 751, a guide shaft 752, a solenoid 753, a guide bias member 754, and a spring 755.

An operation of the switchback device 7 is described. When the switchback device 7 is in a stand-by state, a rotation of the switchback roller 741 is suspended. In this state, the switchback roller 741 is set to a retracted state above the tray 73, and the guide member 751 is also set to a retracted state (shown by the broken line in FIG. 9).

When a sheet P is transported from an upstream-located path 24 with respect to a sheet transport direction of the image forming apparatus inside the switchback device 7, an inlet guide roller pair 241, 242 is driven to transport the sheet P in a sheet entering direction shown by the solid arrow → on the tray 73. When the lead end of the sheet P in the entering direction is about to slide under the switchback roller 741, the switchback roller 741 is pivoted downward to come into contact with the sheet P on the tray 73 and guides the sheet P on the tray 73 further in the entering direction (rightward direction in FIG. 9) by transmitting a counterclockwise rotational driving force of the switchback roller 741 in FIG. 9 to the sheet P which is in contact with the switchback roller 741. When the entirety of the sheet P is guided inside the switchback device 7, the solenoid 753 is turned on, and the guide bias member 754 is changed from the broken-line state in FIG. 9 to the solid-line state shown in FIG. 9 against the spring force of the spring 755. When the guide bias member 754 is set to the solid-line state, the guide member 751 is pivoted downward about the axis of the guide shaft 752 due to the weight thereof, thereby slapping a portion of the sheet P, which is certain distance away from a tail end thereof, while the sheet P is guided in the entering direction onto the tray 73. In this way, the sheet P lands on the tray 73. Then the guide member 751 is pivoted upward to resume its broken line state.

Subsequently, the switchback roller 741 is rotated in the reverse direction (clockwise direction in FIG. 9) to transport the sheet P in exiting direction on the tray 73 (shown by the arrow ← in FIG. 9) toward an outlet guide roller pair 251, 252 disposed on a downstream-located path 25 with respect to the sheet transport direction of the image forming apparatus. Thus, the sheet P exits the switchback device 7 by the outlet guide roller pair 251, 252.

In the above conventional switchback device, the following problem is involved due to the fact that the image forming apparatus is loaded with a fixing unit. In the case where the tail end of the sheet P in the entering direction (namely, the lead end of the sheet P in the exiting direction) has a curled or warped portion, it is difficult to transport the sheet P having the curled portion properly into the downstream-located path 25 via the switchback device 7. A sheet jam or a folded corner end of the sheet P may likely occur when the sheet P is transported in and out of the switchback device 7.

Further, the sheet slapping operation in which the guide member 751 slaps the portion of the sheet P, which is certain distance away from the tail end thereof, against the tray 73 requires a fine adjustment of the timing to promptly transport the sheet P guided from the upstream-located path 24 toward the downstream-located path 25. The sheet transporting unit 74 is an essential element in the conventional switchback device 7 in association with the driving mechanism of moving the switchback roller 741 toward and away from the tray 73 in order to guide the sheet P in and out of the switchback device 7. The conventional switchback device 7 provided with these elements is required to have a complex structure and increases the production cost of the image forming apparatus due to the complex mechanism of accomplishing the sheet slapping operation in combination with driving the switchback roller 741 toward and away from the tray 73.

SUMMARY OF THE INVENTION

It is an object of the present invention to provide a switchback device that enables to accurately transport a sheet downstream with respect to a sheet transport direction while carrying out a switchback operation without a possibility of causing a sheet jam or a folded corner end of the sheet even if the sheet has a curled or warped portion.

According to an aspect of this invention, the switchback device focusing an image forming apparatus comprises: an inverting tray for temporarily holding a sheet guided inside the switchback device thereon; a guide unit for guiding the sheet in pressing contact with the inverting tray when the sheet is transported in an exiting direction on the inverting tray, the exiting direction being opposite to an entering direction of the sheet on the inverting tray; a guide switching unit for selectively changing the guide unit to a sheet guide allow state to allow the sheet to enter the switchback device in the entering direction on the inverting tray and a sheet pressing state to make substantially an end of the sheet in the exiting direction in pressing contact with the inverting tray; and a sheet transporting unit for transporting the sheet out of the switchback device in the exiting direction on the inverting tray.

BRIEF DESCRIPTION OF THE DRAWINGS

FIGS. 5A and 5B are diagrams illustrating an upper guide member and an inverting tray of the switchback device in which FIG. 5A shows a state that a sheet is in pressing contact with the upper guide member and the inverting tray, and FIG. 5B shows a positional relation between upper and lower ribs of the upper guide member and the inverting tray.

DETAILED DESCRIPTION OF THE PREFERRED EMBODIMENTS OF THE INVENTION

Figure 1:
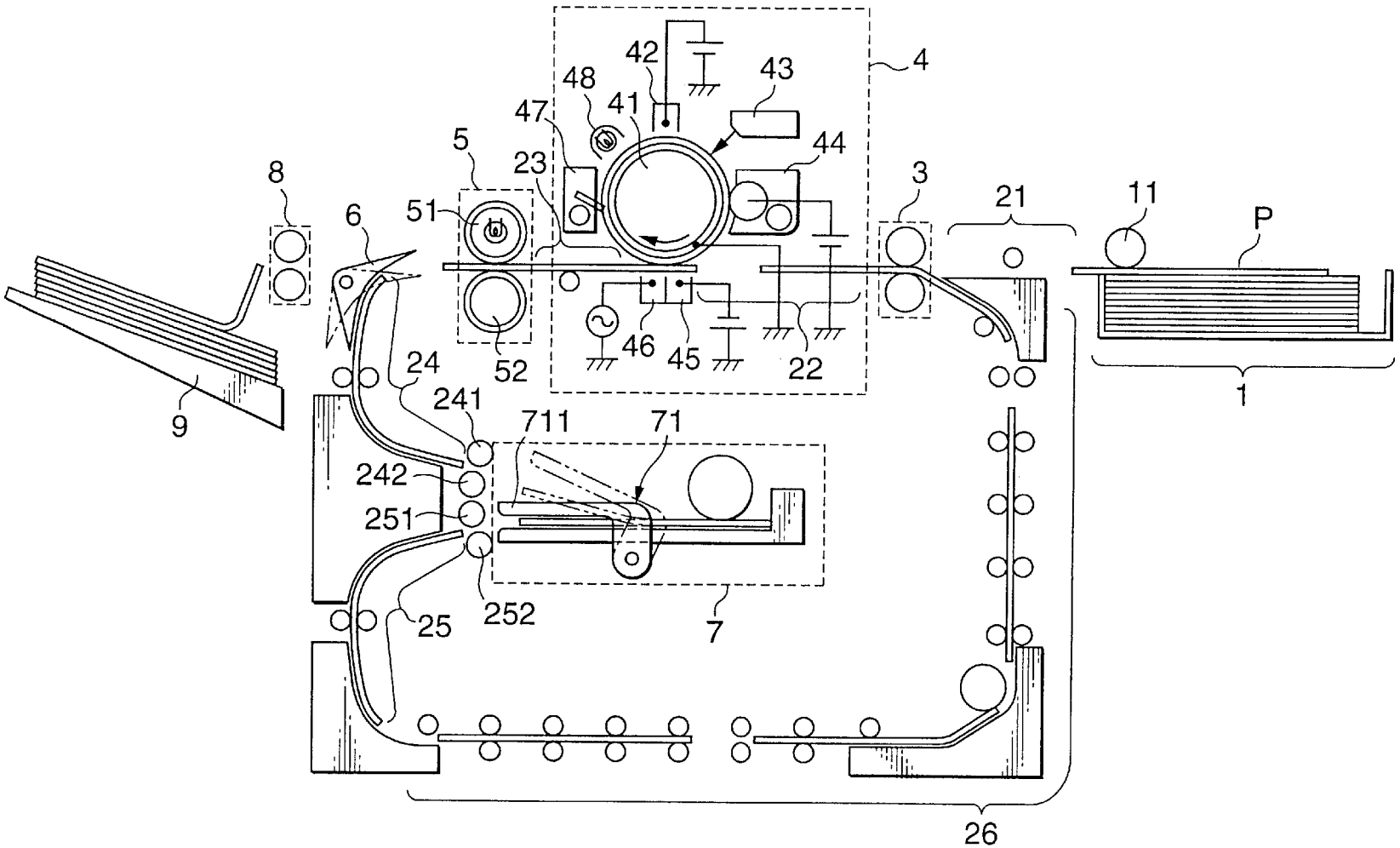
FIG. 1 is a schematic diagram of a switchback device incorporated in an image forming apparatus according to an embodiment of this invention.

FIG. 1 is a diagram illustrating an image forming apparatus incorporated with a switchback device embodying the present invention. An operation of the switchback device when the image forming apparatus implements a double-sided image formation is described referring to FIG. 1.

Sheets accommodated in a sheet cassette 1 are dispensed one by one by a feed roller 11, and the uppermost sheet P stacked in the sheet cassette 1 is transported into a transport path 21, has its transport temporarily suspended when the lead end of the sheet P in a sheet transport direction reaches a registration roller pair 3, and then is transported downstream in the sheet transport direction at a certain timing toward an image forming section 4. When the sheet P is carried to the image forming section 4, a toner image is transferred onto one surface (first surface) of the sheet P by a transfer unit 45. The sheet P carrying the toner image is transported to a nip portion defined by a heater roller 51 and a presser roller 52 of a fixing unit 5 while transported along a transport path 23. While the sheet P passes the nip portion, the toner image on the first surface of the sheet P is fixed by the fixing unit 5. Then, the sheet P after the one side image formation is guided to a switchback device 7 via a transport path 24 by an operation of a switching device 6 for a switchback operation. After carried into the switchback device 7, the sheet P has its transport direction reversed and is transported to a transport path 25. In this way, the switchback operation is completed. Then, the sheet P after the one side image formation is transported to the registration roller pair 3 again via a transport path 26. Upon the lead end of the sheet P reaching the registration roller pair 3, the sheet P has its transport temporarily suspended thereat with the lead end of the sheet P nipped by the registration roller pair 3, and then is transported to the image forming section 4 again at a certain timing for the opposite side image formation. When the sheet P is carried into the image forming section 4 again, a toner image is transferred onto the opposite side (second surface) of the sheet P by the transfer unit 45. The sheet P carrying the toner image on the opposite side thereof is transported to the fixing unit 5 again via the transport path 23 where the toner image on the opposite side of the sheet P is fixed while the sheet P passes the nip portion of the heater roller 51 and the presser roller 52 of the fixing unit 5. The sheet P thus completed with the double-sided image formation is discharged onto a discharge tray 9 via a discharge section by an operation of the switching device 6.

Figure 2:
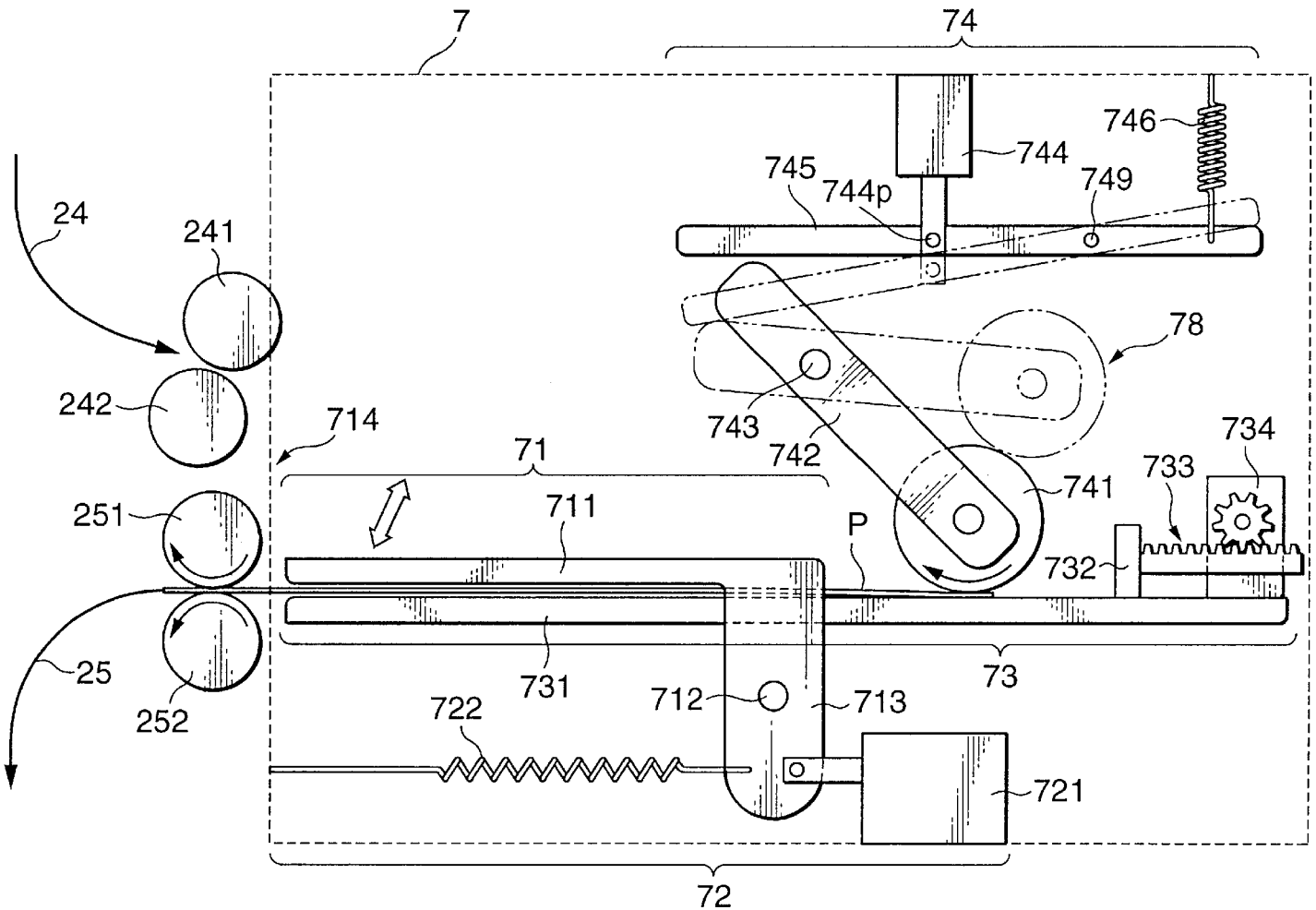
FIG. 2 is a diagram illustrating a construction of the switchback device.
Figure 3:
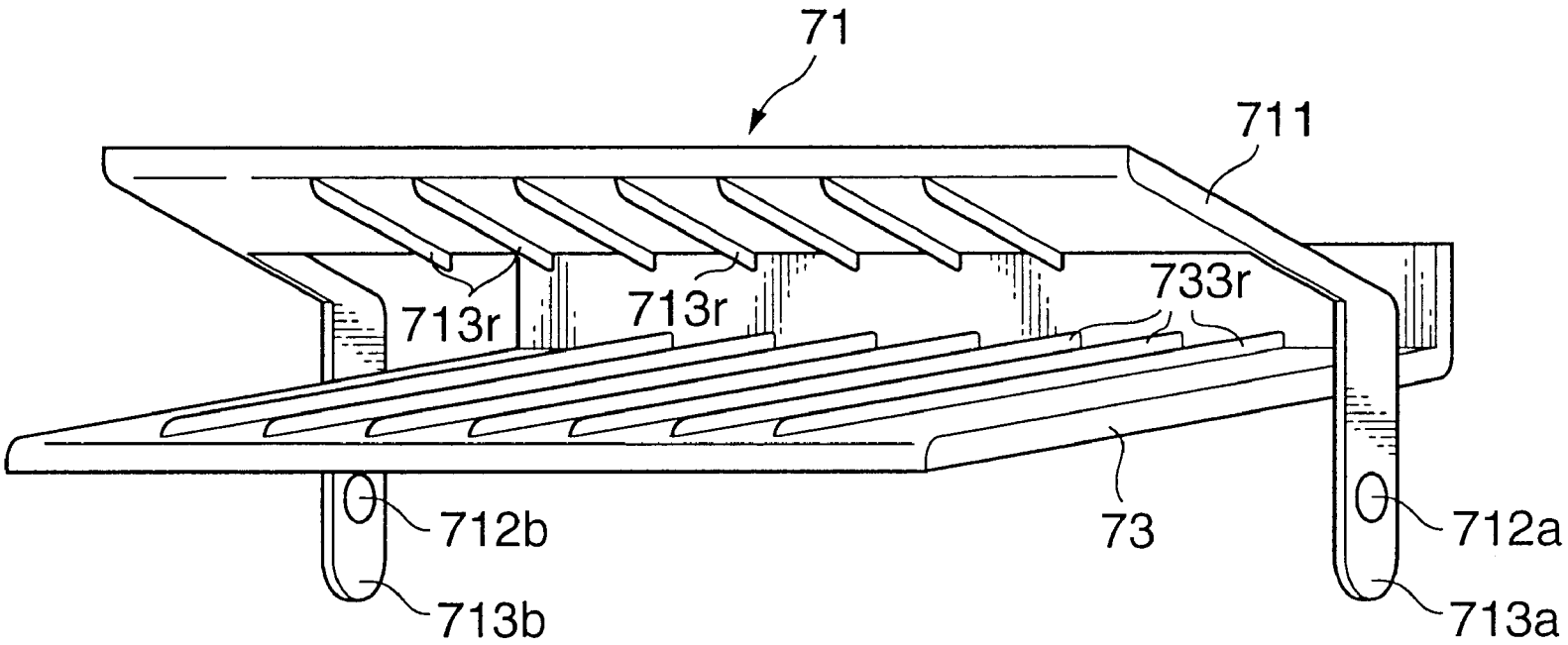
FIG. 3 is a perspective view of the switchback device.

FIG. 2 is a diagram showing a construction of the switchback device incorporated in the image forming apparatus in this embodiment. FIG. 3 is a perspective view of the switchback device. The construction of the switchback device is described in detail referring to FIGS. 2 and 3.

The switchback device 7 includes a presser guide unit 71 (functioning as a guide unit), a presser guide switching unit 72 (functioning as a guide switching unit), an inverting tray 73, and a sheet transporting unit 74. The presser guide unit 71 has an upper guide member 711, a guide shaft 712, and a guide arm 713 (namely, a pair of guide arms 713*a*, 713*b* as shown in FIG. 3). The presser guide switching unit 72 has a presser solenoid 721 and a presser spring 722. The sheet transporting unit 74 has a switchback roller 741, a switchback roller driver 78, a pivotal arm 742, an arm shaft 743, a solenoid 744, an arm bias member 745, and a spring 746.

Specifically, the upper guide member 711 of the presser guide unit 71 is switchingly set to a sheet guide allow state (shown by the broken line in FIG. 1) where the upper guide member 711 is rotated in a clockwise direction from a horizontal plane and a sheet pressing state (shown by the solid line in FIGS. 1 & 2) where the upper guide member 711 covers a left hand portion of a sheet transport plane 731 of the inverting tray 73 from above and maintains a certain clearance therebetween. The sheet pressing state of the upper guide member 711 is set by a downward pivotal movement of the upper guide member 711 about an axis of the guide shaft 712 which is driven by the presser guide switching unit 72. The operation of the presser guide unit 71 is described below in detail.

The above clearance has such a height as to smoothly pass a sheet of a standardized size available on the market and to correct a curl or warp on the surface of the sheet properly, if any, by the time when the sheet is transported to a downstream-located path 25 disposed on a downstream side in the sheet transport direction out of the switchback device 7. In view of the above, it is preferable to set the clearance between 1 mm to 5 mm.

As shown in FIG. 3, the lower surface of the upper guide member 711 which is brought into pressing contact with the sheet P when the upper guide member 711 is set to the sheet pressing state is formed with a series of downwardly projecting upper ribs 713*r* arrayed substantially in parallel to the sheet transport direction on the inverting tray 73 at a certain interval in the width direction of the upper guide member 711 (direction normal to the plane of FIGS. 1 and 2). The upper ribs 713*r* are provided to smoothly transport the sheet P on the inverting tray 73 when the upper guide member 711 is set to the sheet pressing state.

Similar to the above arrangement, the sheet transport plane 731 of the inverting tray 73 is formed with a series of upwardly projecting lower ribs 733*r* arrayed substantially in parallel to the sheet transport direction at a certain interval in the width direction of the upper guide member 711. The lower ribs 733 are provided to smoothly transport the sheet P on the inverting tray 73 in combination with the upper ribs 713 when the upper guide member 711 is set to the sheet pressing state.

Figure 5A:
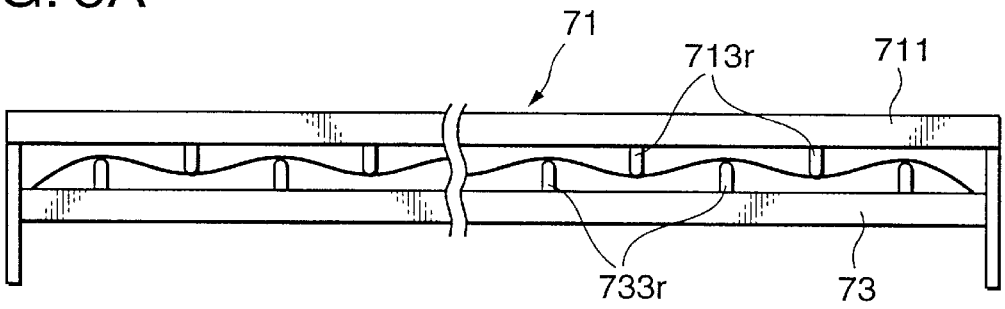
Figure 5B:
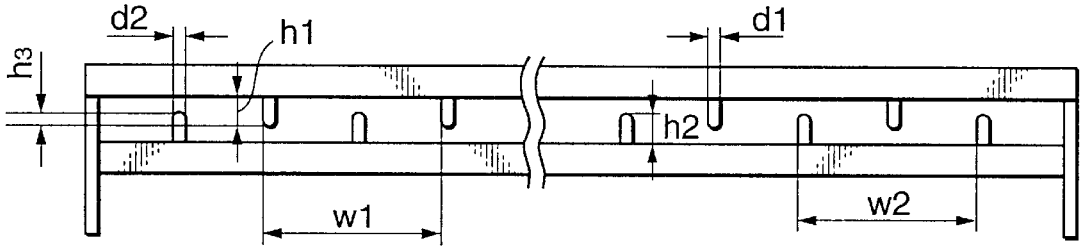

FIGS. 5A and 5B are schematic diagrams illustrating the construction of the upper guide member 711 and the inverting tray 73. FIG. 5A shows a state that a sheet P is transported in the clearance defined by the upper guide member 711 and the inverting tray 73 when the upper guide member 711 is set to a sheet pressing state. FIG. 5B shows the construction of the upper and lower ribs 713*r*, 733*r* in FIG. 5A with the sheet P omitted to clarify the positional relation of the upper and lower ribs 713*r*, 733*r*.

As shown in FIG. 5B, the width d1 of the upper rib 713 and the width d2 of the lower rib 733 are both set in the range of 0.5 mm to 4 mm. Preferably, the width d1 (d2) is set in the range of 1.5 mm to 2.0 mm. The distal ends of the upper ribs 713 (lower ribs 733) are shaped into a U-shape in section with the radius of curvature in the range of 0.25 mm to 2.0 mm. Preferably, the radius of curvature is in the range of 0.75 mm to 1.0 mm.

The upper ribs 713*r* (lower ribs 733*r*) are arrayed at an interval of 40 mm to 60 mm in the width direction of the upper guide member 711 (left and right directions in FIG. 5). Preferably, the interval w1 between the adjacent upper ribs 713*r* and the interval w2 between the adjacent lower ribs 733*r* are both set at 50 mm. The upper and lower ribs 713*r*, 733*r* are alternately arrayed in the width direction of the upper guide member 711.

The height h1 of the upper ribs 713*r* and the height h2 of the lower ribs 733*r*are both set at 5 mm. The vertical dimension h3 overlapping the upper and lower ribs 713*r*, 733*r* is in the range of 1.5 mm to 4.5 mm. Preferably, the dimension h3 is from 2.5 mm to 3.5 mm. Providing the upper and lower ribs 713*r*, 733*r* alternately with the certain height overlapping each other in the vertical direction enables to form a seemingly wavy surface on the sheet P when the sheet P is transported between the upper guide member 711 and the inverting tray 73, as shown in FIG. 5A. Thereby, a curl or warp of the sheet P is corrected while the sheet P passes through the clearance of the upper guide member 711 and the inverting tray 73 having the above configuration.

The presser guide switching unit 72 includes the presser solenoid 721 and the presser spring 722. When the presser solenoid 721 is in an OFF-state, the presser spring 722 connected to a wall (not shown) of the image forming apparatus is urged in leftward direction in FIG. 2 due to its spring force. In this state, the presser spring 722 urges the guide arm 713 in such a direction as to set the upper guide member 711 to the sheet guide allow state (shown by the broken line in FIG. 1) where the upper guide member 711 is pivotally rotated upward about an axis of the guide shaft 712.

On the other hand, when the presser solenoid 721 is turned on, the presser solenoid 721 pulls the guide arm 713 against the spring force of the presser spring 722. Thereby, the upper guide member 711 is set to the sheet pressing state (shown by the solid line in FIG. 1) where the upper guide member 711 is pivotally rotated downward about the axis of the guide shaft 712 with a sufficient clearance defined by the upper guide member 711 and the sheet transport plane 731 of the inverting tray 73.

The inverting tray 73 includes the sheet transport plane 731 and a sheet regulating member 732 (see FIG. 2). As mentioned above, the sheet transport plane 731 is formed with the series of lower ribs 733*r* to smoothly transport the sheet P. The sheet regulating member 732 is an optional item in the switchback device incorporated with the sheet transporting unit 74 according to this invention. In this embodiment, however, the sheet regulating member 732 is provided at a right end of the inverting tray 73 in FIG. 2 to be slidably movable in the sheet transport direction (left and right directions in FIG. 2) in accordance with the size of the sheet in the sheet transport direction. The position of the sheet regulating member 732 is adjusted such that the distance from the sheet regulating member 732 to an access port 714 on the sheet transport plane 731 is set substantially equal to the length of the sheet P in the sheet transport direction (more precisely, slightly longer than the length of the sheet P in the sheet transport direction).

Through the access port 714, the upstream-located path 24 (downstream-located path 25) is connected to the interior of the switchback device 7. The position of the sheet regulating member 732 is set by driving a rack and pinion gear unit 733 and a stepping motor 734 based on a detection signal indicating the size of the sheet P in the sheet transport direction or data concerning the sheet size designated by an operator.

The switchback roller 741 is made of a known material used for a feed roller and transport roller in a conventional image forming apparatus such as EPDM (ethylene-propylene-diene terpolymer), CR rubber (chloroprene rubber), urethane rubber, and natural rubber, and is controllably rotated in clockwise and counterclockwise directions in FIG. 2 by a switchback roller driver 78 to transport the sheet P in and out of the switchback device 7 (left and right directions in FIG. 1, namely, sheet transport direction on the inverting tray 73).

Next, a mechanism of the sheet transporting unit 74 to pivotally move the pivotal arm 742 toward and away from the inverting tray 73 is described. The switchback roller 741 is pivotally rotated about an axis of the arm shaft 743 while supported by the pivotal arm 742. The switchback roller 741 is selectively set to a contact state (shown by the solid line in FIG. 2) where the switchback roller 741 makes contact with the inverting tray 73 and a retracted state (shown by the broken line in FIG. 2) where the switchback roller 741 is retracted above the inverting tray 73.

When the solenoid 744 is in an OFF-state, the switchback roller 741 is set to the retracted state. In this state, the spring 746 connected to a wall (not shown) of the image forming apparatus urges the right end of the arm bias member 745 upward, causing the left end of the arm bias member 745 to press against the end of the pivot arm 742 so that the switchback roller 741 stays above the inverting tray 73. When the sheet P is about to be guided on the inverting tray 73, the solenoid 744 is turned on to set the switchback roller 741 to the contact state. When the solenoid 744 is turned on, a lead end 744*p* of a plunger of the solenoid 744 is retracted upward from the broken-line state to the solid-line state in FIG. 2, causing the arm bias member 745 to rotate about the pivot point 749 clockwise, overcoming the upwardly biased force generated in the spring 746. As a result, the switchback roller 741 is pivotally rotated downward about the axis of the arm shaft 743 by its weight and is set to the contact state when the switchback roller 741 is brought into pressing contact with the sheet P which is being transported on the inverting tray 73.

Figure 4A:
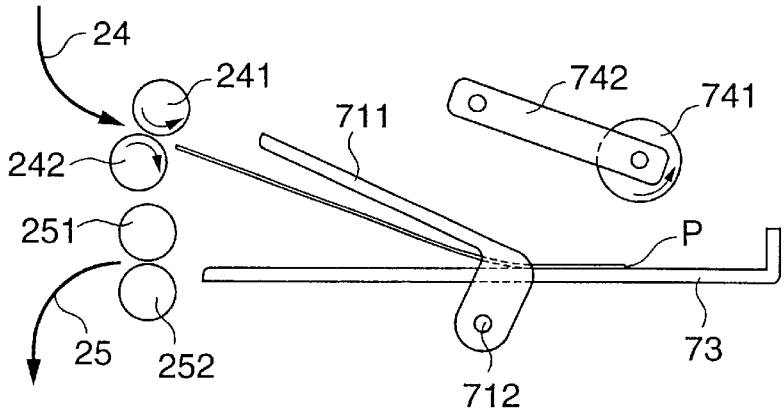
FIGS. 4A to 4C are schematic diagrams showing a sequential operation of the switchback device.
Figure 4B:
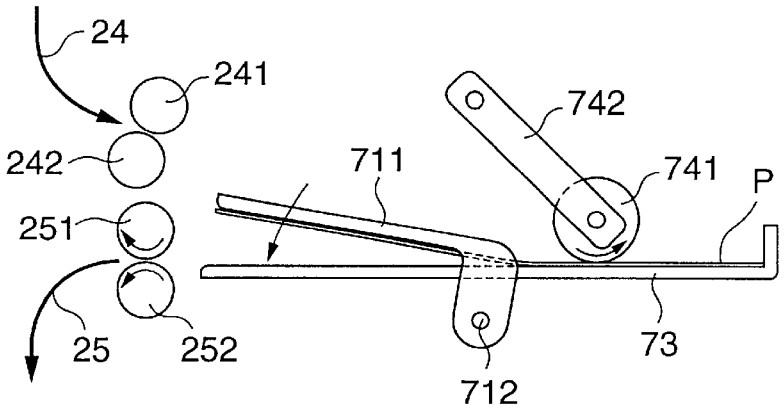

Now, an operation of the switchback device 7 is described with reference to FIGS. 4A to 4C. FIG. 4A shows a state that the switchback device 7 is set to a stand-by state where the switchback device 7 waits for a sheet which is about to be guided into the switchback device 7. In this state, the upper guide member 711 of the presser guide unit 71 is set to a sheet guide allow state. FIG. 4B shows a transitional stage of the switchback device 7 in which the upper guide member 711 is being changed from the sheet guide allow state shown in FIG. 4A to a sheet pressing state shown in FIG. 4C.

In FIG. 4A, the switchback roller 741 is retracted above the inverting tray 73 with its rotation suspended, and the upper guide member 711 of the presser guide unit 71 is set to the sheet guide allow state. When a sheet P is about to be transported into the switchback device 7 in FIG. 4A from the upstream-located path 24, the inlet guide roller pair 241, 242 is driven in such a direction as to guide the sheet P into the switchback device 7.

Next, when the lead end of the sheet P in entering direction on the inverting tray 73 is about to slide under the switchback roller 741, the upper guide member 711 is changed from the sheet guide allow state to the sheet pressing state. Specifically, as shown in FIG. 4B, the switchback roller 741 is pivotally moved downward accompanied by a pivotal movement of the pivotal arm 742 about the axis of the arm shaft 743 and rendered in pressing contacts with the upper surface of the sheet P which is sliding over the inverting tray 73. When the switchback roller 741 is brought into pressing contact with the sheet P, the rotational force of the switchback roller 741 (counterclockwise rotation in FIG. 4B) is transmitted to the sheet P, thereby guiding the sheet P further in the entering direction (rightward direction in FIG. 4B). Upon the entirety of the sheet P coming into the switchback device 7, the presser guide unit 71 is operated by the presser guide switching unit 72 in such a manner as to set the upper guide member 711 to the sheet pressing state where the upper guide member 711 opposes the sheet transport plane 731 of the inverting tray 73 with the certain clearance, as shown in FIG. 4C. In this way, the upper guide member 711 of the presser guide unit 71 is changed from the state shown in FIG. 4A to the state shown in FIG. 4C.

Figure 4C:
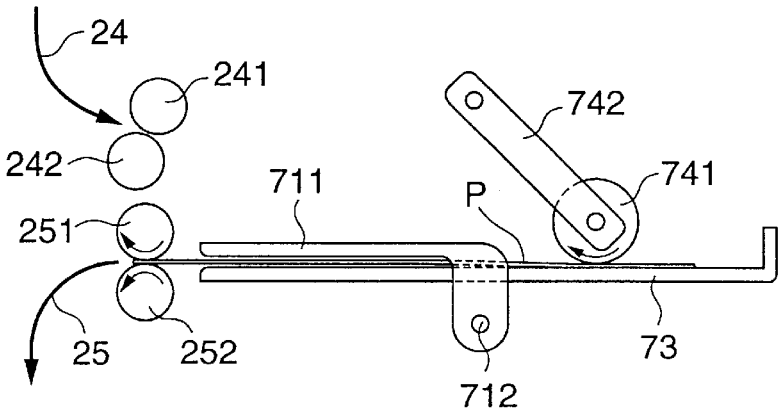

When the upper guide member 711 is set to the sheet pressing state shown in FIG. 4C, the rotation of the switchback roller 741 is reversed (clockwise rotation in FIG. 4C) to transport the sheet P into the downstream-located path 25 by the outlet guide rollers 251, 252, thereby finalizing the switchback operation of the sheet P. FIG. 4C shows a state that the sheet P is about to exit from the switchback device 7 after the switchback operation.

When the lead end of the sheet P in the exiting direction (tail end of the sheet P in the entering direction) is nipped by the outlet guide roller pair 251, 252, the presser solenoid 721 is turned off, and the upper guide member 711 is set to the sheet guide allow state shown in FIG. 4A. Thereby, the switchback device 7 is rendered into a stand-by state to wait for a next sheet.

Figure 6:
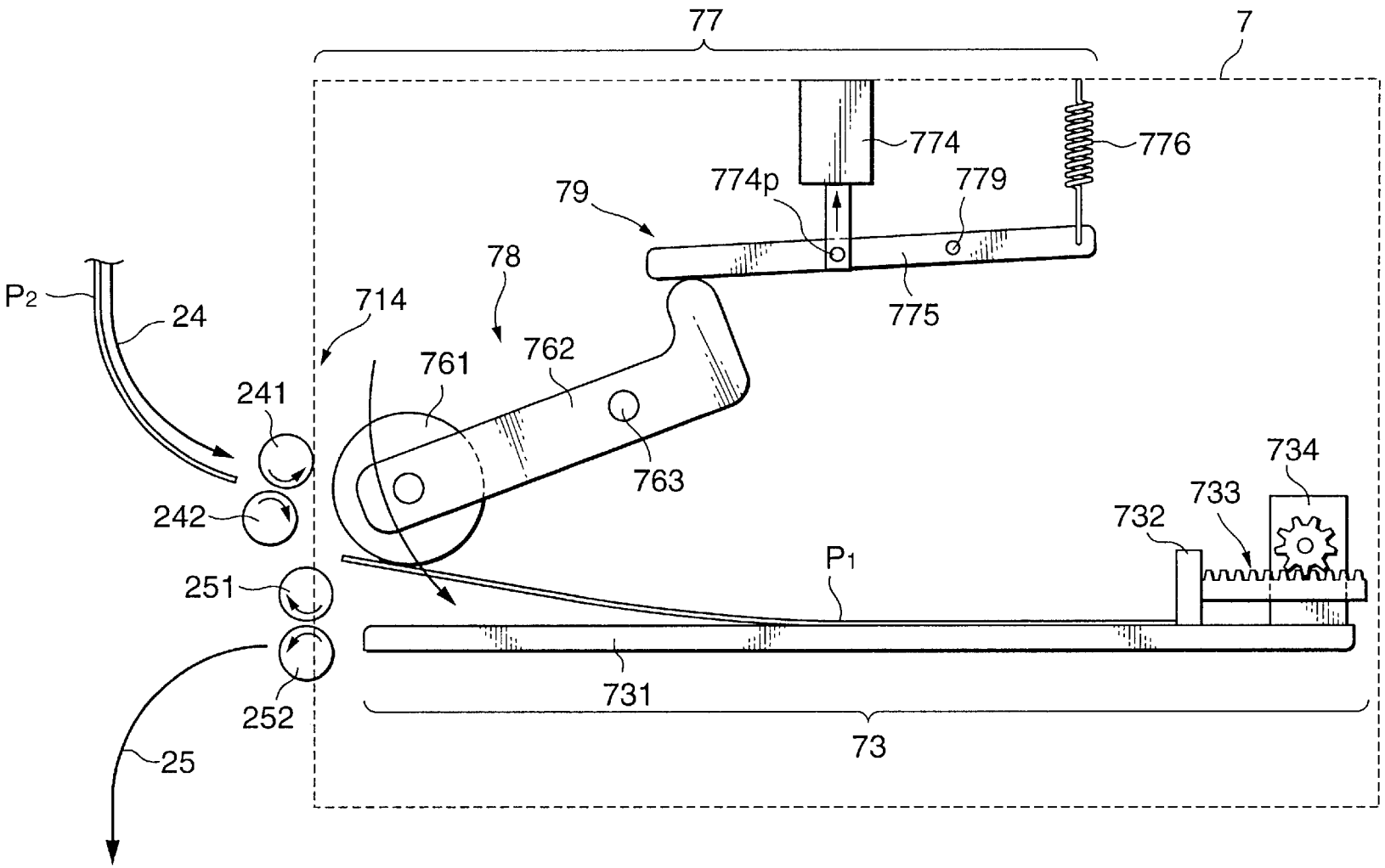
FIGS. 6 and 7 are schematic diagrams of a switchback device of an altered arrangement according to this invention.
Figure 7:
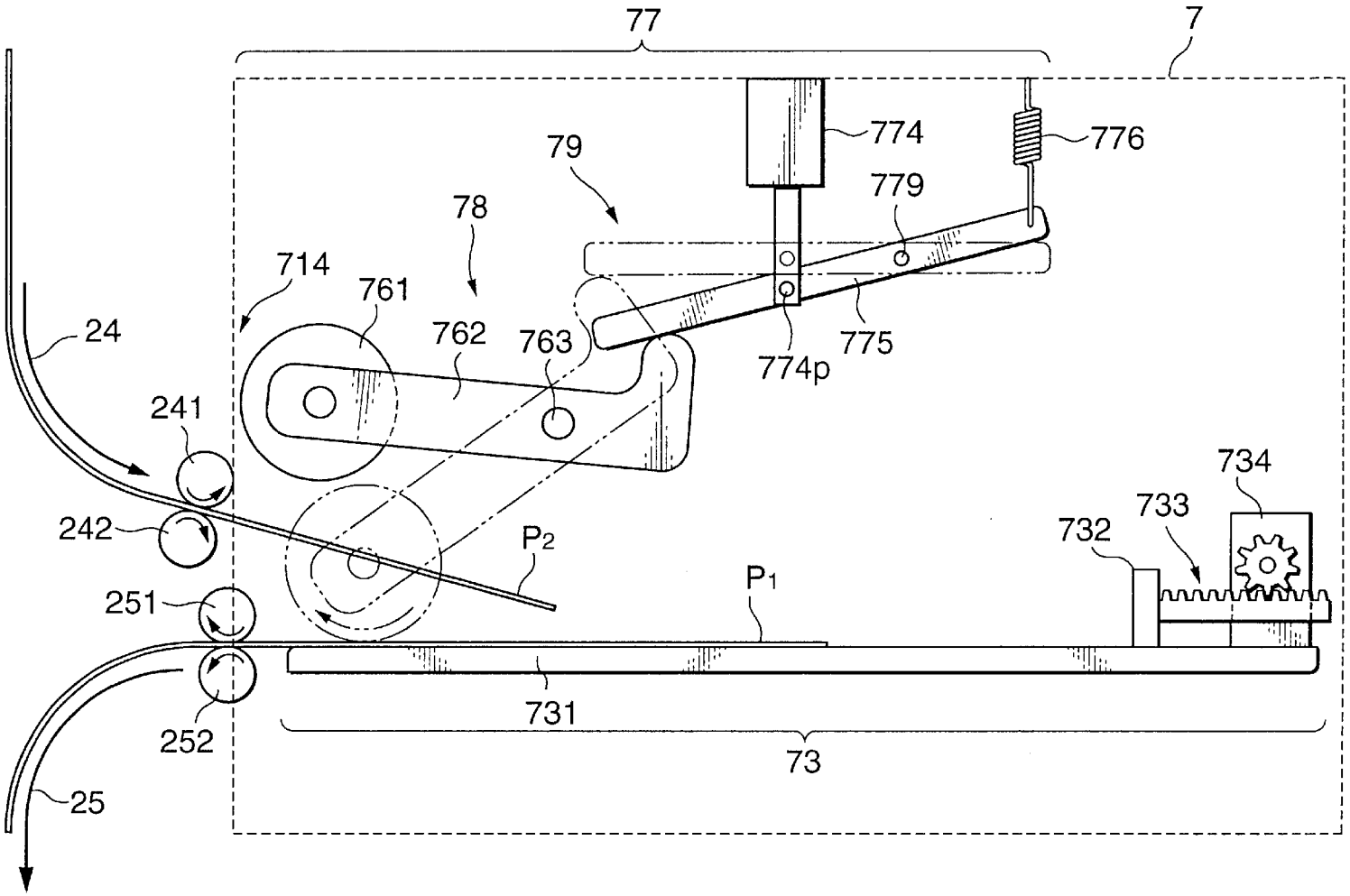

FIGS. 6 and 7 are schematic diagrams of a switchback device of an altered arrangement according to this invention. FIGS. 8A to 8D are a diagrams showing a sequential operation of the switchback device of the altered arrangement. The, switchback device of the altered arrangement is described with reference to FIGS. 6 to 8D in detail. Note that the elements of the altered arrangement are denoted at the same reference numerals as those in the embodiment. In FIGS. 6 to 8D, P1 denotes a first sheet entering a switchback device 7 for a switchback operation, and P2 denotes a next sheet entering the switchback device 7 after the first sheet P1.

The switchback device 7 includes a sheet presser transporter unit 77 and an inverting tray 73. The sheet presser transporter unit 77 includes a switchback roller driver 78 and a switchback roller driving mechanism 79. The switchback roller driver 78 is adapted to rotate a switchback roller 761 in a certain direction. The switchback roller 761, a presser arm 762, an arm shaft 763, a presser solenoid 774, an arm bias member 775, and a presser spring 776 constitute the switchback roller driving mechanism 79.

The switchback roller 761 is made of a known material used for a feed roller and transport roller in a conventional image forming apparatus such as EPDM (ethylene-propylene-diene terpolymer), CR rubber (chloroprene rubber), urethane rubber, and natural rubber. The switchback roller driver 78 drivingly rotates the switchback roller 761 in clockwise direction in FIGS. 6 and 7 to transport the sheet P in leftward or rightward direction in FIGS. 6 and 7 or controllably suspends the rotation thereof.

The mechanism of the sheet presser transporter unit 77, specifically, the construction of the switchback roller driving mechanism 79 (hereinafter also referred to as a switchback roller state change mechanism) is described.

The switchback roller 761 is pivotally supported by the presser arm 762. The switchback roller 761 and the presser arm 762 are urged upward above on a left part of the inverting tray 73 in FIGS. 6 and 7 in a stand-by state. The switchback roller 761 is pivotable about the arm shaft 763 to be selectively set to a sheet pressing state (contact state) where the switchback roller 761 is brought into pressing contact with a sheet guided on the inverting tray 73 and a sheet guide allow state (retracted state) where the switchback roller 761 is urged upward above the inverting tray 73.

The switchback roller 761 is set to the sheet guide allow state in a stand-by state. When the switchback device 7 is in stand-by state, the presser solenoid 74 is turned off. In this state, the presser spring 776 pulls the right end of the arm bias member 775 upward due to its spring force to thereby pivotally lift the presser arm 762 upward in such a direction as to set the switchback roller 761 to the retracted state. Note that the arm bias member 775 is pivotable around a pivot point 779. When the presser solenoid 774 is turned on, the upward lifting force of the arm bias member 775 to pivotally lift the presser arm 762 upward is released against the spring force of the presser spring 776. Thereby, the switchback roller 761 is set to the contact state by the weight thereof to press the tail end of the sheet in the entering direction against a sheet transport plane 731 of the inverting tray 73.

The inverting tray 73 includes the sheet transport plane 731 and a sheet regulating member 732. The sheet transport plane 731 is formed with a series of ribs 733 arrayed at a certain interval in the width direction of the switchback device 7 (direction normal to the plane of FIGS. 6 and 7) to smoothly transport the sheet P on the inverting tray 73. The sheet regulating member 732 is an optional item in the switchback device 7 provided with the sheet presser transporter unit 77. In the altered arrangement, however, the sheet regulating member 732 is provided at a right end of the inverting tray 73 in FIGS. 6 and 7 to be slidably movable in the sheet transport direction (left and right directions in FIGS. 6 and 7) in accordance with the size of the sheet in the sheet transport direction. The position of the sheet regulating member 732 is adjusted such that the distance from the sheet regulating member 732 to an access port 714 on the sheet transport plane 731 is set substantially equal to the length of the sheet P in the sheet transport direction. The position of the sheet regulating member 732 is set by driving a rack and pinion gear unit 733 and a stepping motor 734 based on a detection signal indicating the size of the sheet P in the sheet transport direction or data concerning the sheet size designated by an operator.

Figure 8A:
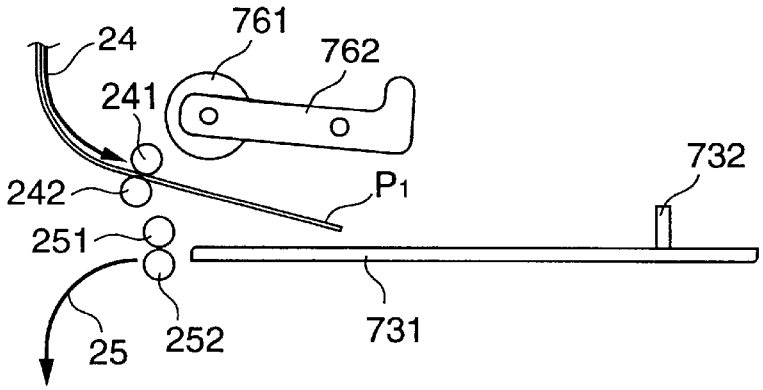
FIGS. 8A to 8D are schematic diagrams showing a sequential operation of the switchback device of the altered arrangement.
Figure 8B:
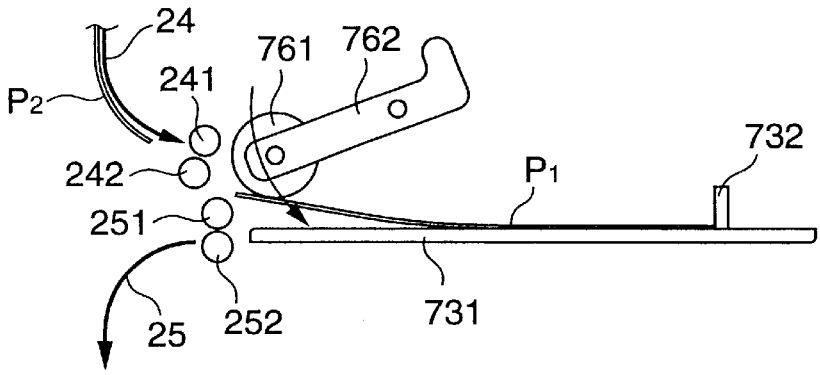
Figure 8C:
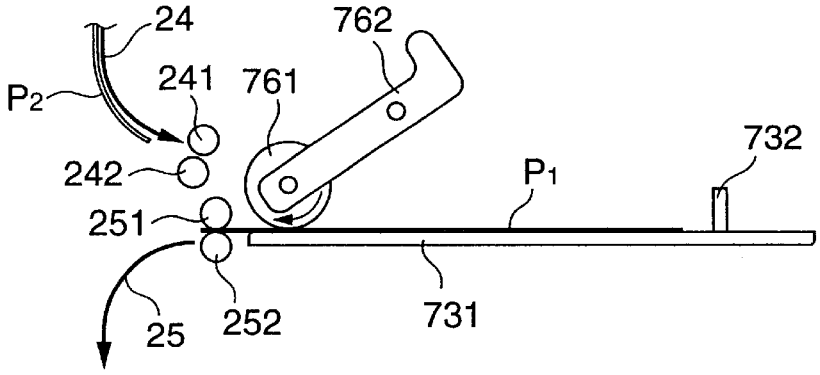
Figure 8D:
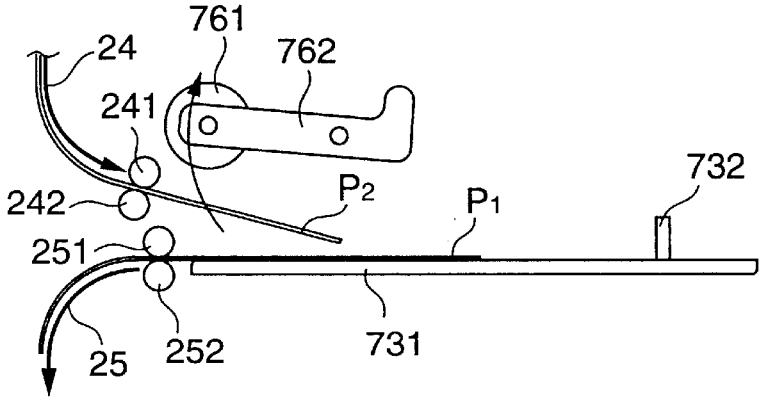
Figure 9:
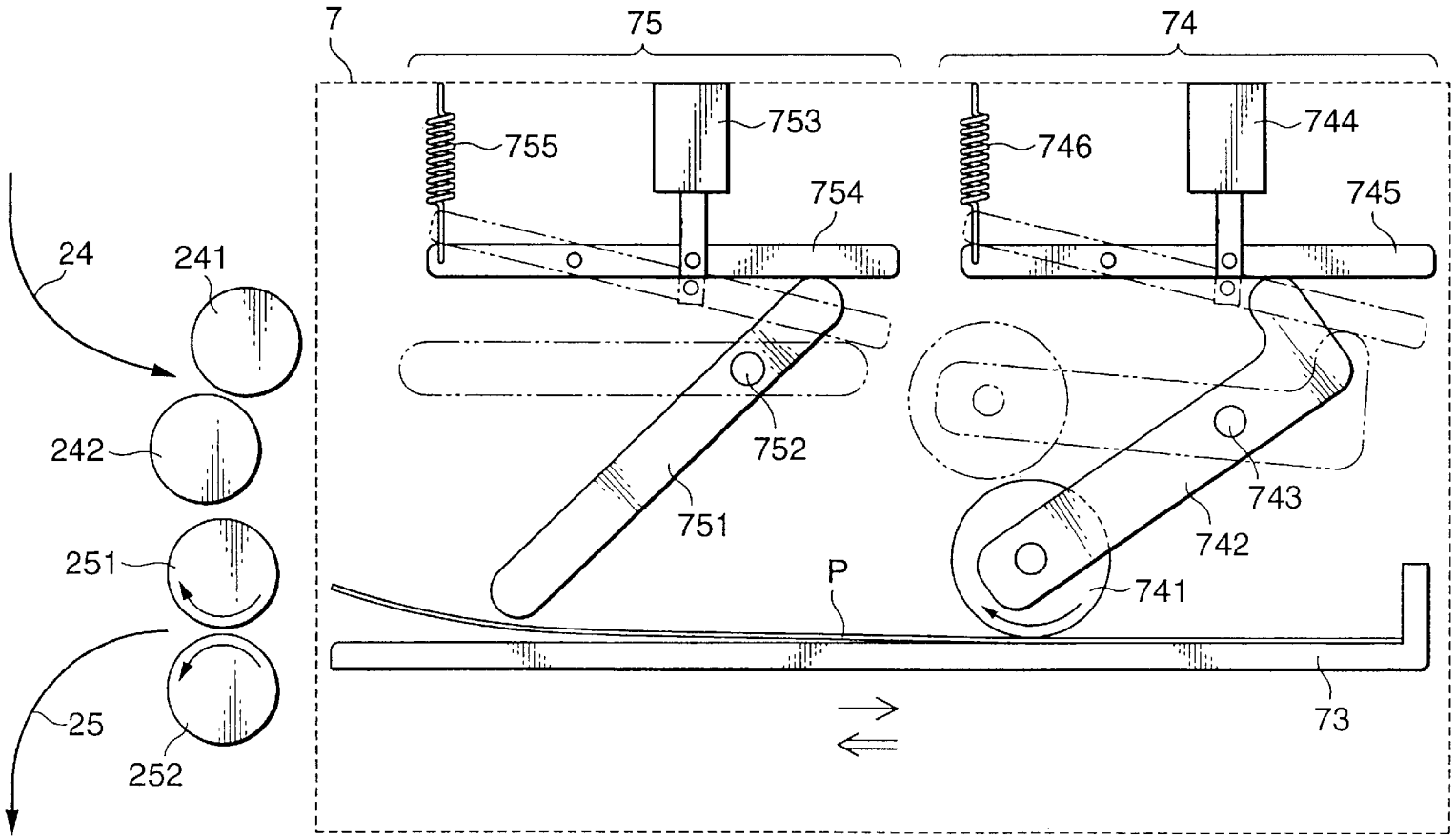
PRIOR ART FIG. 9
FIG. 9 is a schematic diagram of a switchback device according to prior art.

FIGS. 8A to 8D are diagrams showing a sequential operation of the switchback device 7 of the altered arrangement. FIG. 8A shows a state that the switchback device 7 is set to a stand-by state where the switchback device 7 waits for a sheet (in this case, the first sheet P1) which is about to be guided into the switchback device 7. FIG. 8B shows a transitional stage of the switchback device 7 where the switchback device 7 is changed from the sheet guide allow state shown in FIG. 8A to a sheet pressing state shown in FIG. 8C. FIG. 8D shows a state that the switchback device 7 is set to a stand-by state again after a switchback operation of the first sheet P1. In this state, the switchback device 7 is ready to guide a next sheet P2.

In FIG. 8A, the switchback roller 761 is set to a retracted state above the inverting tray 73 with a rotation thereof suspended. When the sheet P1 is transported from an upstream-located path 24, an inlet guide roller pair 241, 242 is driven to guide the sheet P1 inside the switchback device 7.

Next, at a certain timing upon completion of transporting the entirety of the sheet P1 on the inverting tray 73, the switchback roller 761 is pivotally rotated downward about the axis of the arm shaft 763 accompanied by a downward pivotal movement of the presser arm 762 about the axis of the arm shaft 763. In this way, the switchback roller 761 slaps down the tail end of the sheet P1 in the entering direction and presses the sheet P1 against the sheet transport plane 731 of the inverting tray 73. As the switchback roller 761 is rotated in counterclockwise direction in pressing contact with the sheet P1, the sheet P1 is guided further in the entering direction (rightward direction in FIG. 8B).

The switchback roller 761 slaps down the sheet P1 at a certain timing upon lapse of a certain time duration after a sheet sensor (not shown) such as a photo interrupter provided near the access port 714 detects passing of the tail end of the sheet P1.

Subsequently, upon rendering the sheet P1 in pressing contact with the sheet transport plane 731 of the inverting tray 73, the switchback roller 761 starts rotating in clockwise direction in FIG. 8C to transport the sheet P into a downstream-located path 25 by an outlet guide roller pair 251, 252. As shown in FIG. 8C, the sheet P1 in an contact with the switchback roller 761 is transported toward the downstream-located path 25 on the inverting tray 73.

The presser solenoid 744 is turned off at a certain timing after the lead end of the sheet P1 in the exiting direction is securely nipped by the outlet guide roller pair 251, 252 and before the lead end of the next sheet P2 enters the switchback device 7. When the presser solenoid 744 is turned off, the switchback roller 761 is set to a retracted state. Thus, as shown in FIG. 8D, the switchback device 7 is set to a sheet guide allow state to guide the next sheet P2 inside the switchback device 7 with the first sheet P1 exiting the switchback device 7 after the switchback operation.

In this way, the sheet presser transporter unit 77 is sequentially operated as shown in FIGS. 8A to 8D to accomplish a sequential switchback operation of sheets which are guided into the switchback device 7 one after another.

As shown in FIG. 7, the switchback roller 761 in the altered arrangement is rotated in clockwise direction upon making contact with the sheet P1 with such a rotation amount as to enable the lead end of the sheet P1 in the exiting direction to reach the nip position of the outlet guide roller pair 251, 252. In this arrangement, the switchback roller 761 is promptly returned to the retracted state to wait for the next sheet P2 coming into the switchback device 7. This altered arrangement contributes to shortening the time required for an image formation as a whole.

Note that the term "sheet" throughout the description of this specification includes all kinds of sheets on which an image can be formed such as cut sheet used in image forming apparatus, transparent sheet for Over Head Projector (OHP), tracing paper, and sheet made of a material capable of color image formation.

In the above embodiment, the switchback device of this invention is described in the case where the switchback device is incorporated in the image forming apparatus capable of double-sided image formation. Alternatively, the switchback device of this invention may be incorporated in an image forming apparatus capable of composite image formation in which a plurality of sub-images are formed in combination on one side of a sheet.

In the above embodiment, when a sheet is guided in the entering direction on the inverting tray 73, the switchback roller 741 (or 761) is rotated in counterclockwise direction to cause the sheet to abut against the sheet regulating member 732 provided on the right end of the inverting tray 73, and then is rotated in clockwise direction to transport the sheet in exiting direction toward the outlet guide roller pair 251, 252 to finalize a switchback operation. Alternatively, when a sheet is guided in the entering direction on the inverting tray 73, the rotation of the switchback roller 741 (or 761) may be suspended for a certain time duration to allow the sheet to abut against the sheet regulating member 732 utilizing the inertia force of the sheet entering into the switchback device 7.

In the above embodiment, as the sheet is being guided on the inverting tray 73, the presser guide unit 71 is set to a sheet pressing state. As an altered form, the presser guide unit 71 may be set to a sheet pressing state at a certain timing when the lead end of a sheet in the entering direction is about to pass under the switchback roller 741 or the tail end of the sheet in the entering direction is about to pass between the inlet guide roller pair 241, 242.

In the embodiment, the presser guide unit 71 (guide unit) is kept in the sheet pressing state until the sheet is securely nipped by the outlet guide roller pair 251, 252 after a switchback operation. Alternatively, it may be possible to set the presser guide unit 71 to a sheet pressing state at least once during a time period after the sheet is guided inside the switchback device 7 and before the lead end of the sheet in the exiting direction is securely nipped by the outlet guide roller pair 251, 252. This altered arrangement also makes it possible to correct a warp of a sheet in a vertical direction while the sheet is guided in the clearance defined by the sheet transport plane 731 of the inverting tray 73 and the upper guide member 711 of the presser guide unit 71 opposing each other even if the sheet has a curled or warped portion.

To sum up the above, according to an aspect of this invention, a switchback device for use in an image forming apparatus comprising: an inverting tray for temporarily holding a sheet guided inside the switchback device thereon; a guide unit for guiding the sheet in pressing contact with the inverting tray when the sheet is transported in an exiting direction on the inverting tray, the exiting direction being opposite to an entering direction of the sheet on the inverting tray; a guide switching unit for selectively changing the guide unit to a sheet guide allow state to allow the sheet to enter the switchback device in the entering direction on the inverting tray and a sheet pressing state to make substantially an end of the sheet in the exiting direction in pressing contact with the inverting tray; and a sheet transporting unit for transporting the sheet out of the switchback device in the exiting direction on the inverting tray.

In this arrangement, the guide unit pressingly guides the sheet against the inverting tray while the sheet is being transported on the inverting tray. In this state, the opposite sides of the sheet are securely guided by two planes (namely, guide unit and the inverting tray) respectively. Accordingly, even if the sheet has a curled or warped portion, the sheet transport is regulated in a vertical direction on the inverting tray, and the sheet is transported to the downstream-located path after correcting the warp or curl of the sheet in the vertical direction, if any. Also, this arrangement is effective in solving a problem such as sheet jam and folded corner end of the sheet which may likely to result from a sheet transport in and out of the switchback device of transporting the sheet having a curled portion.

According to another aspect of this invention, the guide unit is kept in the sheet pressing state after the sheet has entered the switchback device in the entering direction on the inverting tray until the sheet exits the switchback device in the exiting direction on the inverting tray.

In this arrangement, the guide unit keeps pressingly guiding the sheet against the inverting tray for the time period after the sheet is guided in the entering direction onto the inverting tray until the sheet exits the switchback device in the exiting direction on the inverting tray. The sheet is kept in pressing guide state between the guide unit and the inverting tray for the certain time period. This arrangement simplifies the operation of the guide unit and enhances the curl or warp correction effect due to the prolonged time of rendering the sheet in pressing contact with the guide unit and the inverting tray.

According to yet another aspect of this invention, the guide unit is set to the sheet pressing state after the sheet has entered the switchback device in the entering direction on the inverting tray, and is changed to the sheet guide allow state before a next sheet enters the switchback device in the entering direction on the inverting tray.

In this arrangement, the guide unit keeps pressingly guiding the sheet against the inverting tray for a certain time duration after the sheet is guided in the entering direction on the inverting tray. Thus, the opposite sides of the sheet are kept in pressing guide state by the planes of the guide unit and the inverting tray while the sheet is transported on the inverting tray. The guide unit is changed from the sheet pressing state to the sheet guide allow state before the next sheet enters the switchback device. In this way, keeping the guide unit in the sheet pressing state for the certain time duration after the first sheet is guided onto the inverting tray and before the next sheet comes into the switchback device simplifies the operation of the guide unit and enhances the curl correction effect of the sheet due to the prolonged time of rendering the sheet in pressing contact with the guide unit and the inverting tray.

According to still another aspect of this invention, a switchback device for use in an image forming apparatus comprising: an inverting tray for temporarily holding a sheet guided inside the switchback device thereon; and a sheet presser transporter unit including a switchback roller, a switchback roller state change mechanism for selectively changing the switchback roller to a sheet guide allow state to allow the sheet to enter the switchback device in the entering direction on the inverting tray and a sheet pressing state to make the sheet in pressing contact with the inverting tray, and a switchback roller driver for driving the switchback roller to transport the sheet in an exiting direction opposite to the entering direction on the inverting tray and the switchback roller state change mechanism sets the switchback roller to the sheet pressing state at a time when the sheet is guided into the switchback device and at a time when the sheet is guided out of the switchback device.

In this arrangement, the switchback roller presses the sheet against the inverting tray at a time when the sheet is guided into the switchback device and when the sheet is guided out of the switchback device. In this way, since the switchback roller directly presses the sheet against the inverting tray, the sheet is securely transported toward the downstream-located path. Also, this arrangement is effective in solving a problem such as sheet jam and folded corner end of the sheet which may likely to result from a sheet transport in and out of the switchback device of transporting the sheet having a curled portion.

According to a further aspect of this invention, the sheet pressing state of the switchback roller is set to begin upon completion of the sheet transport into the switchback device in the entering direction and the sheet pressing state is kept until the sheet exits the switchback device in the exiting direction.

In this arrangement, the switchback roller keeps pressingly guiding the sheet against the inverting tray for a certain time duration after completion of the sheet transport onto the inverting tray until the sheet is about to exit the switchback device. The opposite sides of the sheet are kept in pressing guide state by the switchback roller and the inverting tray for the certain time duration. Thus, driving the switchback roller to keep pressing the sheet directly against the inverting tray for the prolonged time securely transports the sheet toward the. downstream-located path and simplifies the operation of the switchback roller.

According to yet another aspect of this invention, the switchback roller is set to the sheet pressing state upon completion of the sheet transport into the switchback device in the entering direction on the inverting tray, and is changed to the sheet guide allow state before a next sheet enters the switchback device.

In this arrangement, the switchback roller keeps pressing the sheet against the inverting tray for a certain time duration after completion of the sheet transport onto the inverting tray until the sheet is about to exit the switchback device. The opposite sides of the sheet are kept in pressing guide state by the switchback roller and the inverting tray for the certain time duration. The switchback roller is changed from the sheet pressing state to the sheet guide allow state before the next sheet enters the switchback device. In this way, driving the switchback roller to keep pressing the sheet directly against the inverting tray for the prolonged time securely transports the sheet toward the downstream-located path and simplifies the operation of the switchback roller.

According to a still further aspect of this invention, the switchback roller comes into pressing contact with a tail end of the sheet in the entering direction on the inverting tray after the sheet has entered the switchback device In this arrangement, the switchback roller presses the tail end of the sheet in the entering direction against the inverting tray when the sheet is guided in the entering direction on the inverting tray. The opposite sides of the sheet are guided by the switchback roller and the inverting tray, thereby eliminating a possibility of sheet jam and folded corner end of the sheet.

According to yet another aspect of this invention, a switchback device for use in an image forming apparatus comprising: an inverting tray for temporarily holding a sheet guided in a specified sheet transport direction thereon; a guide unit for guiding the sheet in pressing contact with the inverting tray when the sheet exits the switchback device in an exiting direction on the inverting tray, the exiting direction being opposite to an entering direction of the sheet on the inverting tray; a guide switching unit for selectively changing the guide unit to a sheet guide allow state to allow the sheet to enter the switchback device in the entering direction on the inverting tray and a sheet pressing state to make the sheet in pressing contact with the inverting tray; and a sheet transporting unit for transporting the sheet out of the switchback device in the exiting direction on the inverting tray, wherein a lower surface of the guide unit is formed with a plurality of ribs arrayed at a certain interval in a width direction of the guide unit, the width direction being substantially orthogonal to the sheet transport direction, an upper surface of the inverting tray is formed with a plurality of ribs arrayed at a certain interval in the width direction of the guide unit, and the guide switching unit selectively sets the guide unit to the sheet pressing state at least one time during a time period after the sheet has entered the switchback device in the entering direction on the inverting tray until the sheet exits the switchback device in the exiting direction on the inverting tray.

In this arrangement, the guide unit presses the sheet against the inverting tray at least once during a time duration after the sheet is guided in the entering direction on the inverting tray until the sheet is about to exit the switchback device in the exiting direction on the inverting tray. A warp or curl of the sheet in a vertical direction is corrected while the sheet is guided by the upper and lower ribs protruding in the vertical direction even if the sheet has such a curled or warped portion. Further, this arrangement is effective in solving a problem such as sheet jam and folded corner end of the sheet which may likely to result from a sheet transport in and out of the switchback device even if the sheet has such a curled or warped portion.

According to a further aspect of this invention, the guide unit is kept in the sheet pressing state after the sheet has entered the switchback device in the entering direction on the inverting tray until the sheet is about to exit the switchback device in the exiting direction on the inverting tray.

In this arrangement, the guide unit keeps pressingly guiding the sheet against the inverting tray for a certain time duration after the sheet is guided in the entering direction on the inverting tray until the sheet is about to exit the switchback device in the exiting direction on the inverting tray. A warp or curl of the sheet in the vertical direction is corrected while the sheet is guided in pressing contact With the guide unit and the inverting tray for the prolonged time even if the sheet has such a curled or warped portion. Keeping the guide unit in pressing contact state for the prolonged time simplifies the driving operation of the guide unit and enhances the curl correction effect of the sheet due to the prolonged time of rendering the sheet in pressing contact with the guide unit and the inverting tray.

According to a still further aspect of this invention, the guide unit is set to the sheet pressing state after the sheet has entered the switchback device in the entering direction on the inverting tray, and is changed to the sheet guide allow state before a next sheet enters the switchback device in the entering direction on the inverting tray.

In this arrangement, the guide unit keeps pressing the sheet against the inverting tray for a certain time duration after the sheet is guided into the switchback device in the entering direction on the inverting tray and before the next sheet enters the switchback device onto the inverting tray. A warp or curl of the sheet in the vertical direction is corrected while the sheet is guided in pressing contact with the guide unit and the inverting tray for the prolonged time even if the sheet has such a curled or warped portion. Keeping the guide unit in pressing contact state for the prolonged time simplifies the operation of the guide unit and enhances the curl correction effect of the sheet. Further, the guide unit is changed from the sheet pressing state to the sheet guide allow state before the next sheet is guided onto the inverting tray. This arrangement simplifies the driving operation of the guide unit.

According to yet another aspect of this invention, the ribs of the guide unit and the ribs of the inverting tray are alternately arrayed in the width direction of the guide unit.

In this arrangement, a warp or curl of the sheet in the vertical direction is corrected by the ribs of the guide unit and the ribs of the inverting tray while the sheet passes between the guide unit and the inverting tray. Thus, a warped or curled portion of the sheet is securely corrected.

According to still another aspect of this invention, the ribs of the guide unit and the ribs of the inverting tray overlap each other for a certain length in a vertical direction when said guide unit is set to said sheet pressing state.

In this arrangement, a warp or curl of the sheet in the vertical direction is corrected while the sheet passes between the ribs of the guide unit and the ribs of the inverting tray.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A switchback device for use in an image forming apparatus comprising:

an inverting tray for temporarily holding a sheet guided inside the switchback device thereon;

a guide unit for guiding the sheet in pressing contact with the inverting tray when the sheet is transported in an exiting direction on the inverting tray, the exiting direction being opposite to an entering direction of the sheet on the inverting tray;

a guide switching unit for selectively changing the guide unit to a sheet guide allow state to allow the sheet to enter the switchback device in the entering direction on the inverting tray and a sheet pressing state to make substantially an end of the sheet in the exiting direction in pressing contact with the inverting tray; and a sheet transporting unit for transporting the sheet out of the switchback device in the exiting direction on the inverting tray.

2. The switchback device according to claim 1, wherein the guide unit is kept in the sheet pressing state after the sheet has entered the switchback device in the entering direction on the inverting tray until the sheet exits the switchback device in the exiting direction on the inverting tray.

3. The switchback device according to claim 1, wherein the guide unit is set to the sheet pressing state after the sheet has entered the switchback device in the entering direction on the inverting tray, and is changed to the sheet guide allow state before a next sheet enters the switchback device in the entering direction on the inverting tray.

4. The switchback device according to claim 1, wherein the guide unit includes an upper guide plate member which is placed above said inverting tray and is pivotable around an axis extending in a widthwise direction thereof to thereby make the guide plate member openable toward the sheet entering the switchback device when the guide unit is in the sheet guide allow state.

5. The switchback device according to claim 4, wherein said guide plate member has a lead end in the exiting direction and said inverting tray has a horizontal end in the exiting direction and said lead end and said horizontal end are substantially aligned when the guide unit is in the sheet pressing state.

6. A switchback device for use in an image forming apparatus, comprising:

an inverting tray for temporarily holding a sheet guided inside the switchback device thereon;

a guide unit for guiding the sheet in pressing contact with the inverting tray when the sheet is transported in an exiting direction on the inverting tray, the exiting direction being opposite to an entering direction of the sheet on the inverting tray, the guide unit including an upper guide plate member which is placed above said inverting tray and is pivotable around an axis extending in a widthwise direction thereof to thereby make the guide plate member openable toward the sheet entering the switchback device when the guide unit is in the sheet guide allow state, said guide plate member having a lead end in the exiting direction and said inverting tray having a horizontal end in the exiting direction, said lead end and said horizontal end being substantially aligned when the guide unit is in the sheet pressing state, said guide unit further including a pair of guide arms extending downward from opposite ends of said guide plate member in the widthwise direction and said guide arms each being pivotably attached to said axis that is provided underneath the inverting plate such that a span between said guide arm pair is wider than a width of the inverting tray in the widthwise direction;

a guide switching unit for selectively changing the guide unit to a sheet guide allow state to allow the sheet to enter the switchback device in the entering direction on the inverting tray and a sheet pressing state to make substantially an end of the sheet in the exiting direction in pressing contact with the inverting tray; and a sheet transporting unit for transporting the sheet out of the switchback device in the exiting direction on the inverting tray.

7. A switchback device for use in an image forming apparatus comprising:

an inverting tray for temporarily holding a sheet guided inside the switchback device thereon; and a sheet presser transporter unit including a switchback roller, a switchback roller state change mechanism for selectively changing the switchback roller to a sheet guide allow state to allow the sheet to enter the switchback device in the entering direction on the inverting tray and a sheet pressing state to make the sheet in pressing contact with the inverting tray, and a switchback roller driver for driving the switchback roller to transport the sheet in an exiting direction opposite to the entering direction on the inverting tray and the switchback roller state change mechanism sets the switchback roller to the sheet pressing state at a time when the sheet is guided into the switchback device and at a time when the sheet is guided out of the switchback device.

8. The switchback device according to claim 7, wherein the sheet pressing state of the switchback roller is set to begin upon completion of the sheet transport into the switchback device in the entering direction and the sheet pressing state is kept until the sheet exits the switchback device in the exiting direction.

9. The switchback device according to claim 7, wherein the switchback roller is set to the sheet pressing state upon completion of the sheet transport into the switchback device in the entering direction on the inverting tray, and is changed to the sheet guide allow state before a next sheet enters the switchback device.

10. The switchback device according to claim 7, wherein the switchback roller comes into pressing contact with a tail end of the sheet in the entering direction on the inverting tray after the sheet has entered the switchback device.

11. A switchback device for use in an image forming apparatus comprising:

an inverting tray for temporarily holding a sheet guided in a specified sheet transport direction thereon;

a guide unit for guiding the sheet in pressing contact with the inverting tray when the sheet exits the switchback device in an exiting direction on the inverting tray, the exiting direction being opposite to an entering direction of the sheet on the inverting tray;

a guide switching unit for selectively changing the guide unit to a sheet guide allow state to allow the sheet to enter the switchback device in the entering direction on the inverting tray and a sheet pressing state to make the sheet in pressing contact with the inverting tray; and a sheet transporting unit for transporting the sheet out of the switchback device in the exiting direction on the inverting tray, wherein a lower surface of the guide unit is formed with a plurality of ribs arrayed at a certain interval in a width direction of the guide unit, the width direction being substantially orthogonal to the sheet transport direction, an upper surface of the inverting tray is formed with a plurality of ribs arrayed at a certain interval in the width direction of the guide unit, and the guide switching unit selectively sets the guide unit to the sheet pressing state at least one time during a time period after the sheet has entered the switchback device in the entering direction on the inverting tray until the sheet exits the switchback device in the exiting direction on the inverting tray.

12. The switchback device according to claim 11, wherein the guide unit is kept in the sheet pressing state after the sheet has entered the switchback device in the entering direction on the inverting tray until the sheet is about to exit the switchback device in the exiting direction on the inverting tray.

13. The switchback device according to claim 11, wherein the guide unit is set to the sheet pressing state after the sheet has entered the switchback device in the entering direction on the inverting tray, and is changed to the sheet guide allow state before a next sheet enters the switchback device in the entering direction on the inverting tray.

14. The switchback device according to claim 11, wherein the ribs of the guide unit and the ribs of the inverting tray are alternately arrayed in the width direction of the guide unit.

15. The switchback device according to claim 14, wherein the ribs of the guide unit and the ribs of the inverting tray overlap each other for a certain length in a vertical direction when said guide unit is set to said sheet pressing state.

16. The switchback device according to claim 11, wherein the guide unit includes an upper guide plate member having said lower surface formed with said plural ribs and said upper guide plate member is placed above said inverting tray and is pivotable around an axis extending in a widthwise direction thereof to thereby make the guide plate member openable toward the sheet entering the switchback device when the guide unit is in the sheet guide allow state.

17. The switchback device according to claim 16, wherein said guide plate member has a lead end in the exiting direction and said inverting tray has a horizontal end in the exiting direction and said lead end and said horizontal end are substantially aligned when the guide unit is in the sheet pressing state.

18. The switchback device according to claim 17, wherein said guide unit includes a pair of guide arms extending downward from opposite ends of said guide plate member in the widthwise direction and said guide arms each is pivotably attached to said axis that is provided underneath the inverting plate such that a span between said guide arm pair is wider than a width of the inverting tray in the widthwise direction.

* * * * *